US011359587B2

(12) United States Patent
Flores Corona et al.

(10) Patent No.: US 11,359,587 B2
(45) Date of Patent: Jun. 14, 2022

(54) AIR FILTER DEVICE IN AN AIR INTAKE SYSTEM FOR AN ENGINE AND METHOD FOR USE OF SAID DEVICE

(71) Applicant: Ford Global Technologies, LLC, Dearborn, MI (US)

(72) Inventors: Jorge Flores Corona, Naucalpan (MX); Jose Quezada, Tlalnepantla (MX); Juan Pablo Salgado, Atizapan de Zaragoza (MX); Roger Joseph Khami, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 307 days.

(21) Appl. No.: 16/659,864

(22) Filed: Oct. 22, 2019

(65) Prior Publication Data

US 2021/0115883 A1 Apr. 22, 2021

(51) Int. Cl.
*F02M 35/024* (2006.01)
*F02M 35/10* (2006.01)
*F02M 35/04* (2006.01)

(52) U.S. Cl.
CPC .... *F02M 35/02483* (2013.01); *F02M 35/044* (2013.01); *F02M 35/10013* (2013.01); *F02M 35/10144* (2013.01)

(58) Field of Classification Search
CPC ..... F02M 35/02483; F02M 35/10013; F02M 35/10144; F02M 35/044; F02M 35/1255
See application file for complete search history.

(56) References Cited

U.S. PATENT DOCUMENTS

| | | | | |
|---|---|---|---|---|
| 3,249,172 | A | 5/1966 | De Lorean | |
| 4,300,488 | A | 11/1981 | Cser | |
| 5,640,937 | A | 6/1997 | Slopsema | |
| 6,067,953 | A | 5/2000 | Bloomer | |
| 7,143,736 | B2 | 12/2006 | Jessberger et al. | |
| 8,925,510 | B2 | 1/2015 | Stec et al. | |
| 9,950,288 | B2 | 4/2018 | Holzmann et al. | |
| 2010/0275862 | A1* | 11/2010 | Cassell, Jr | F02M 35/06 123/41.57 |
| 2015/0059304 | A1* | 3/2015 | Kaufmann | B01D 46/0021 55/502 |

FOREIGN PATENT DOCUMENTS

| | | | |
|---|---|---|---|
| EP | 0896148 A2 | 2/1999 | |
| WO | WO-2013104796 A1 * | 7/2013 | B01D 46/526 |

* cited by examiner

*Primary Examiner* — Jacob M Amick
*Assistant Examiner* — Charles J Brauch
(74) *Attorney, Agent, or Firm* — Geoffrey Brumbaugh; McCoy Russell LLP

(57) ABSTRACT

Systems and methods are provided for an air filter device. In one example, the air filter device includes a housing enclosing a filter element positioned in a filter enclosure, the filter element including an outlet in fluidic communication with a downstream intake line and an inlet conduit extending through the housing and delivering air to the filter enclosure, and the inlet conduit including a wall dividing the filter enclosure from the inlet conduit. The air filter device further includes a cover sealingly attached to the wall and a peripheral lip of the housing.

20 Claims, 10 Drawing Sheets

AIR FILTER DEVICE IN AN AIR INTAKE SYSTEM FOR AN ENGINE AND METHOD FOR USE OF SAID DEVICE

FIELD

The present description relates generally to an air filter device in an air intake system for an internal combustion engine and method for use of said device and system.

BACKGROUND/SUMMARY

Engines have previously utilized airboxes to convey filtered air downstream to intake system components such as throttles, intake manifolds, and the like. In some cases, airboxes have contained complex routing of internal passages due to the disparate positioning of the airboxes inlets and outlets, for example. Furthermore, vibration and noise traveling from the airbox, and more generally the intake system, to the cabin has also created issues related to passenger comfort and customer satisfaction.

Prior intake systems have attempted to reduce noise, vibration, and harshness (NVH) by incorporating flexible fittings into an inlet pipe of the airbox. For instance, one example approach shown by Stec et al., in U.S. Pat. No. 8,925,510, is an airbox with a flexible fitting designed to mount in the engine compartment. The flexible fitting, attempts to isolate the airbox from components coupled thereto to reduce the amount of noise and vibration transferred between the components and then to the vehicle cabin. Other designs have endeavored to tune the intake system's acoustic properties by incorporating resonator devices therein. Resonators have the drawback of increasing the size, cost, and complexity of the intake system.

The inventors have recognized at least some of the aforementioned drawbacks and developed an air filter device to at least partially overcome some of the drawbacks. In one example, the air filter device includes a housing enclosing a filter element positioned in a filter enclosure. The filter element includes an outlet in fluidic communication with a downstream intake line. The air filter device further includes an inlet conduit extending through the housing and delivering ambient air to the filter enclosure. The inlet conduit includes a wall dividing the filter enclosure from a flow passage of the inlet conduit. The air filter device also includes a cover sealingly attached to the wall and a peripheral lip of the housing. In this way, air may be routed through the filter using a compact arrangement. The air filter device may consequently be more easily packaged in desired vehicle locations, such as the engine compartment. Furthermore, providing a cover sealing both the inlet conduit and the filter chamber, enables the manufacturing cost of the device to be reduced when compared to other intake airboxes with separately manufactured covers and intake conduits. Routing air through the integrated inlet conduit also allows for adaptive resonance tuning in the device to achieve desired acoustic properties (e.g., noise attenuation) in the device and reduce NVH.

In one example, the filter element may be cylindrical and fixedly attached to a cylindrical conduit extending through a wall of the housing. The cylindrical filter enclosure allows for resonance tuning, if desired. Characteristics such as the duct length, cross sectional area and enclosure volume, etc., may be selected to tune the device for frequency attenuation, to further reduce NVH. Furthermore, the interaction between the cylindrical filter and inlet conduit allows for more granular tuning of the device's acoustic characteristics.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-11 are drawn approximately to scale. However, other relative dimensions may be used, in other embodiments.

DETAILED DESCRIPTION

The following description relates to an air filter device in an air intake system providing airflow to an engine. The air filter device may include, in one example, an integrated inlet conduit whose boundary is at least partially defined by a wall separating a filter enclosure in the device from the inlet conduit. The air filter device further includes a cover with a seal engaging a lip of the wall as well as a peripheral lip in a housing of the device. Providing an inlet conduit integrated into the device in this manner allows the compactness of the device to be increased, if desired, when compared to devices with external intake conduits. Integrating the inlet conduit into the interior of the device also allows resonance tuning in the device to be achieved, if desired. For instance, the inlet conduit may extend vertically in the device and expel air towards a lower surface of the housing, allowing the conduit to reduce a noise, vibration, and harshness (NVH) in the intake system. To elaborate, characteristics such as the duct length, cross sectional area and enclosure volume, etc., may be selected to tune the device for frequency attenuation, to further reduce NVH. In another example, the air filter device may include a cylindrical filter connected to a cylindrical conduit extending through the housing of the device and in fluidic communication with downstream components in the intake system. The cylindrical filter allows for more granular resonance tuning and further reductions in NVH, if desired.

Figure 1:
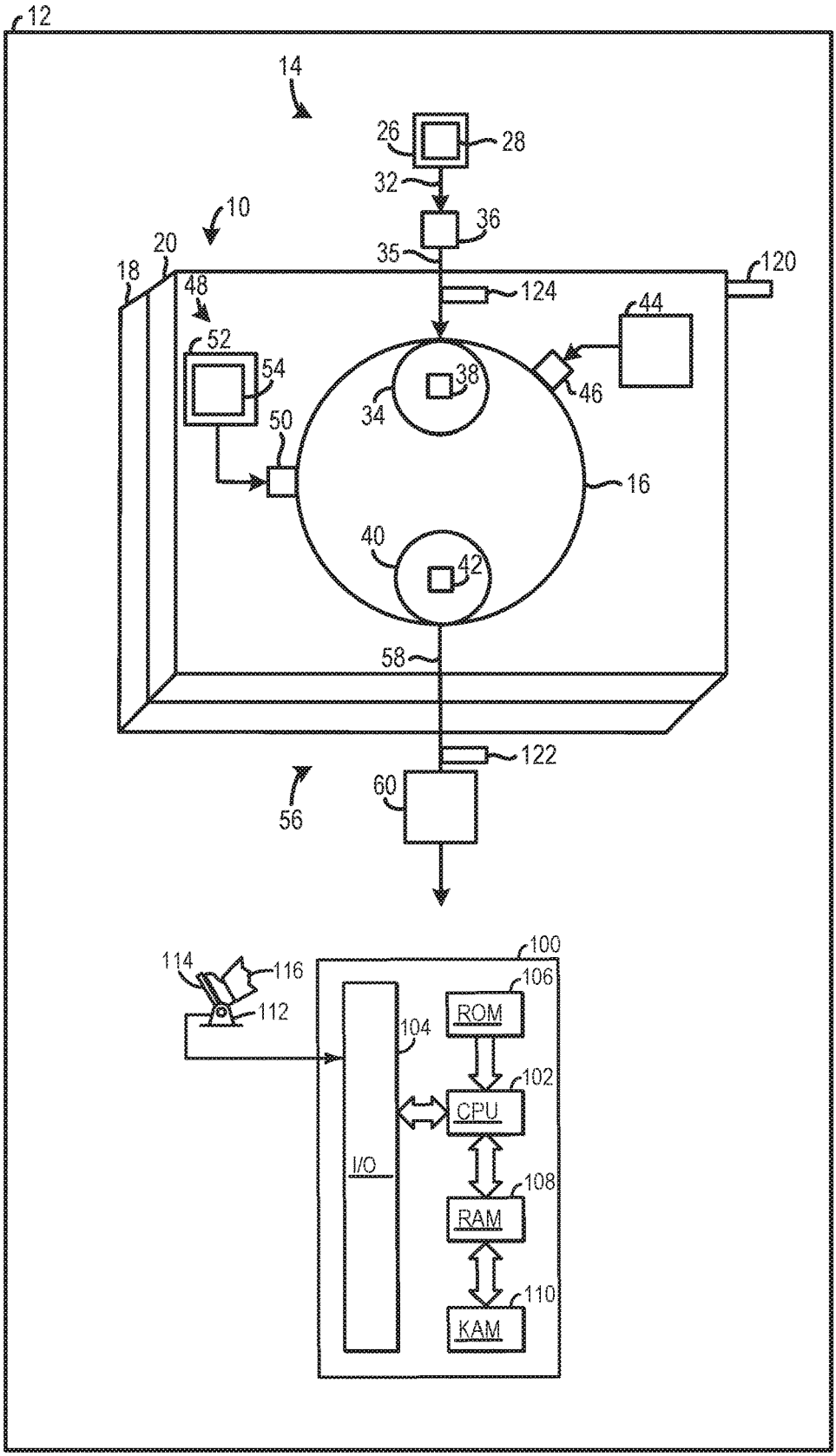
FIG. 1 shows a schematic depiction of an internal combustion engine including an air intake system.
Figure 2:
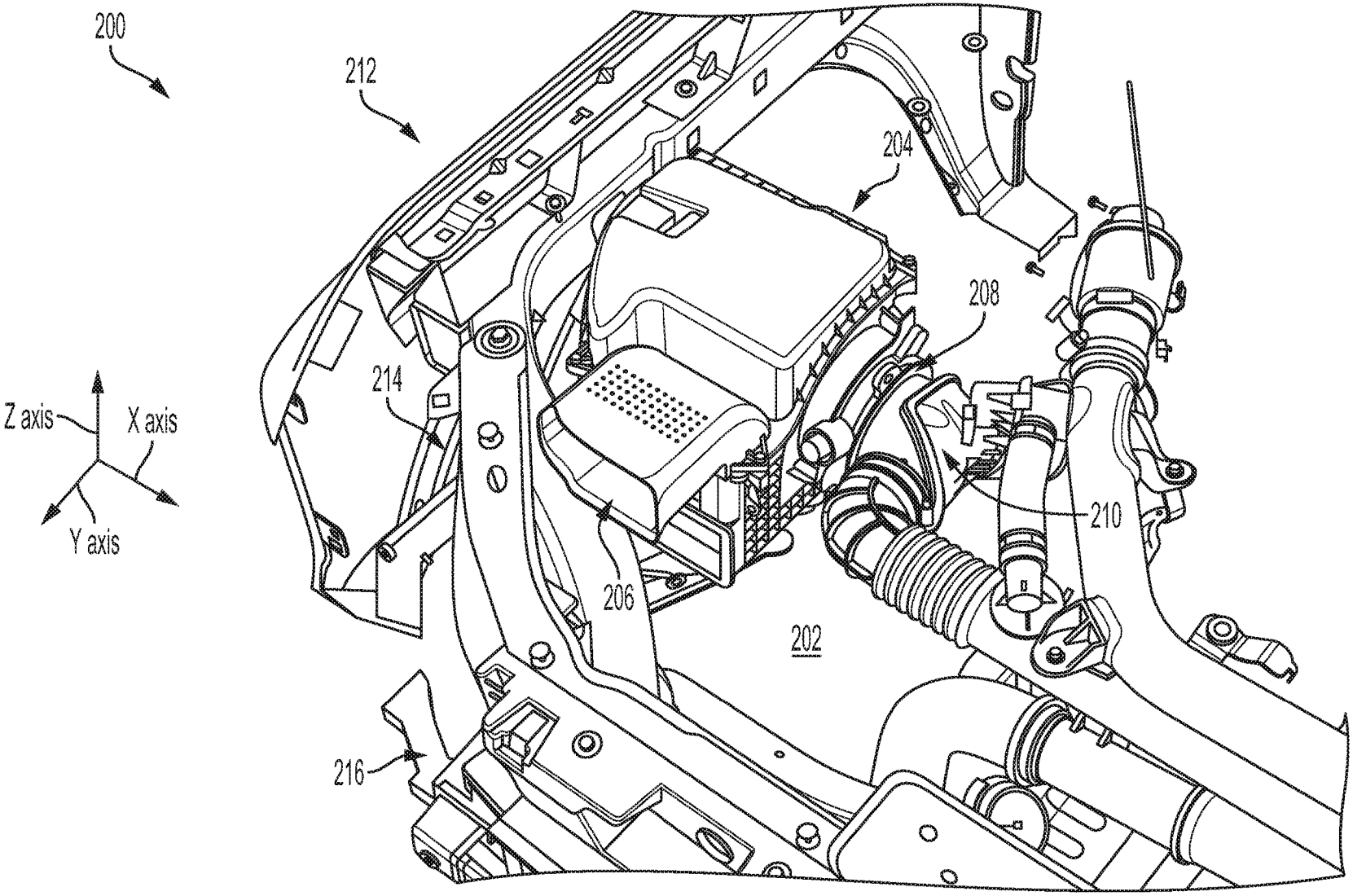
FIG. 2 shows a perspective view of an example of a vehicle including an air intake system.
Figure 3:
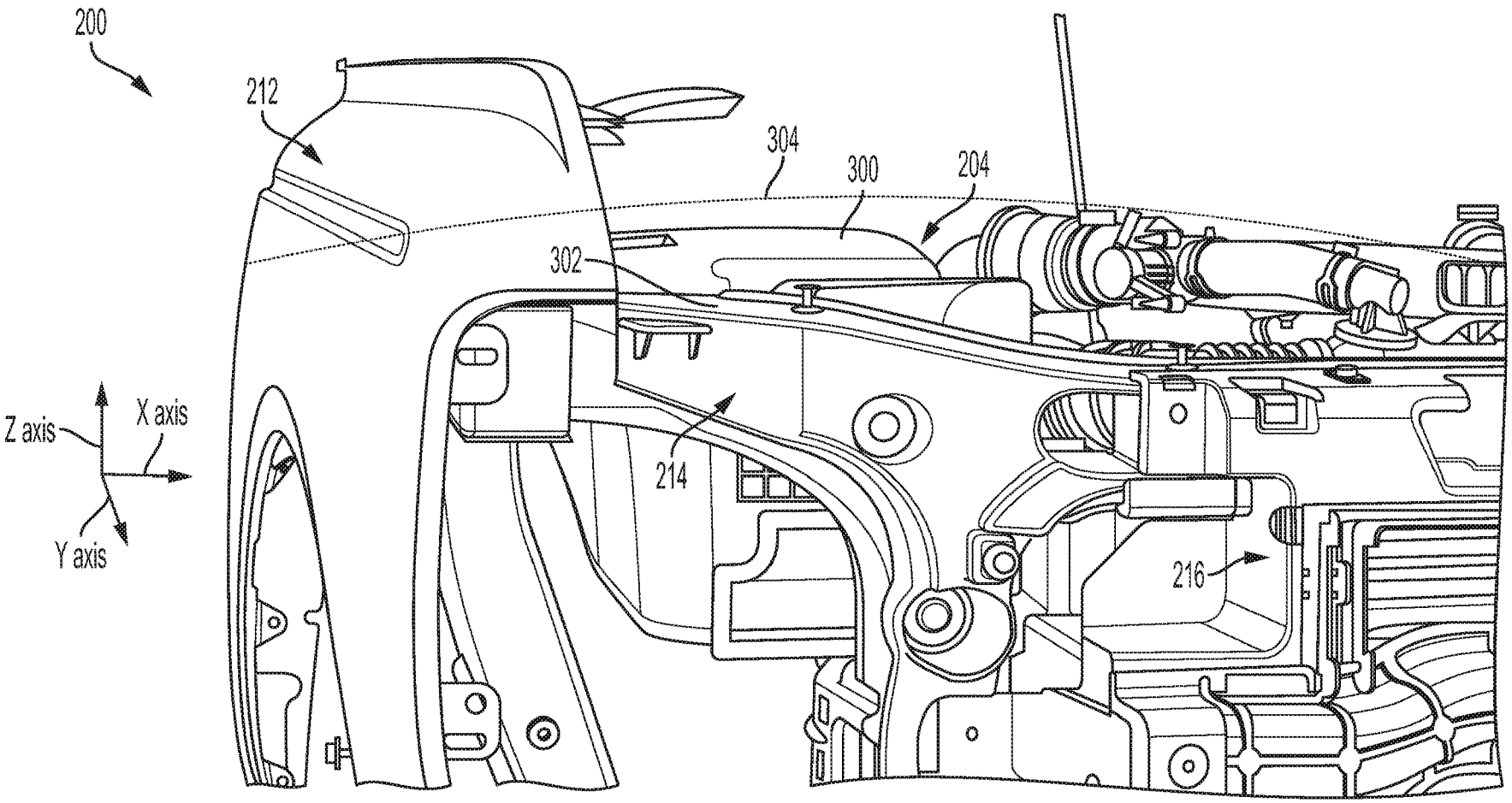
FIG. 3 shows a front view of the vehicle and the air intake system, illustrated in FIG. 2.
Figure 4:
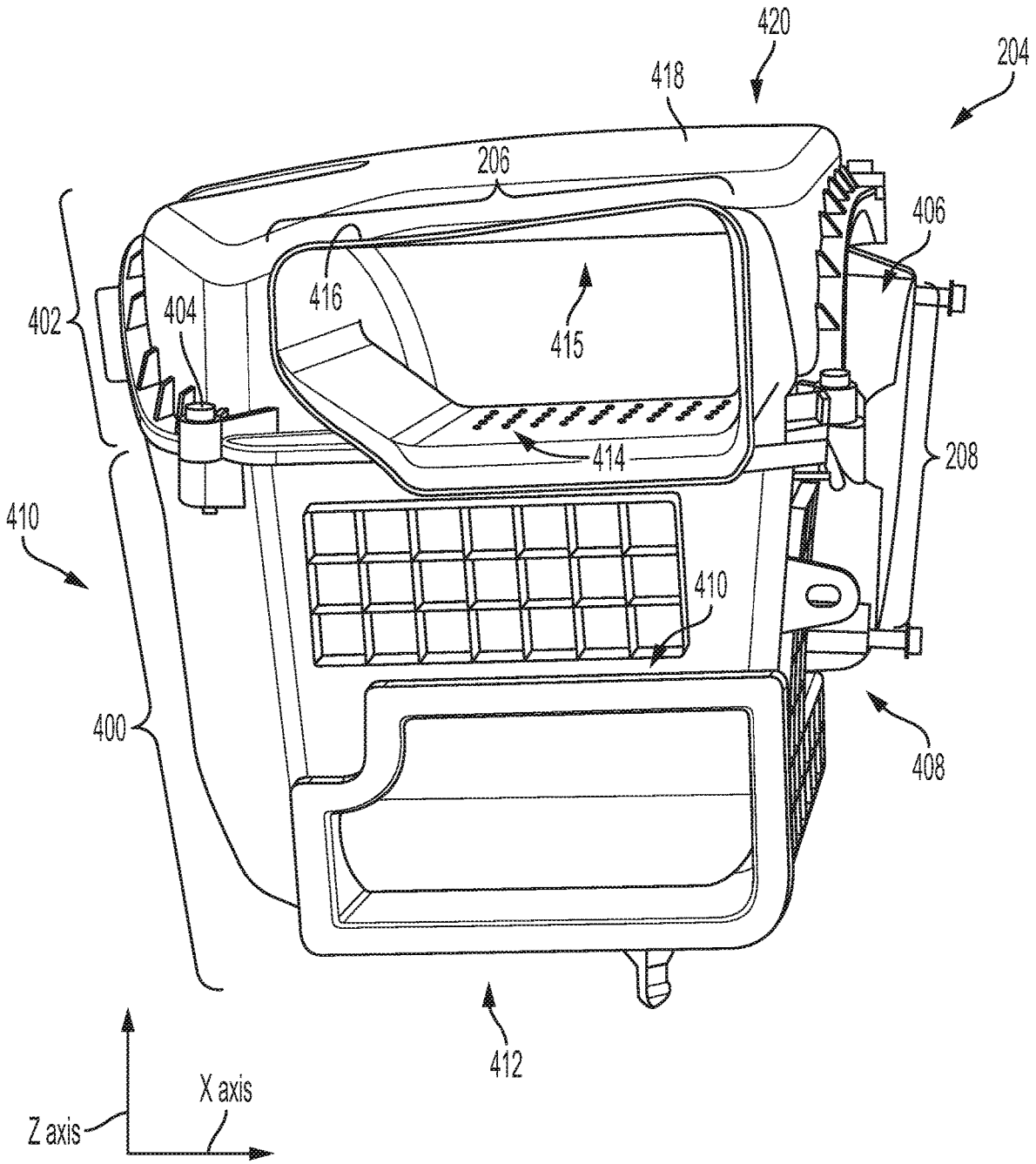
FIG. 4 shows a detailed view of an air filter device included in the air intake system, illustrated in FIGS. 2 and 3.
Figure 5:
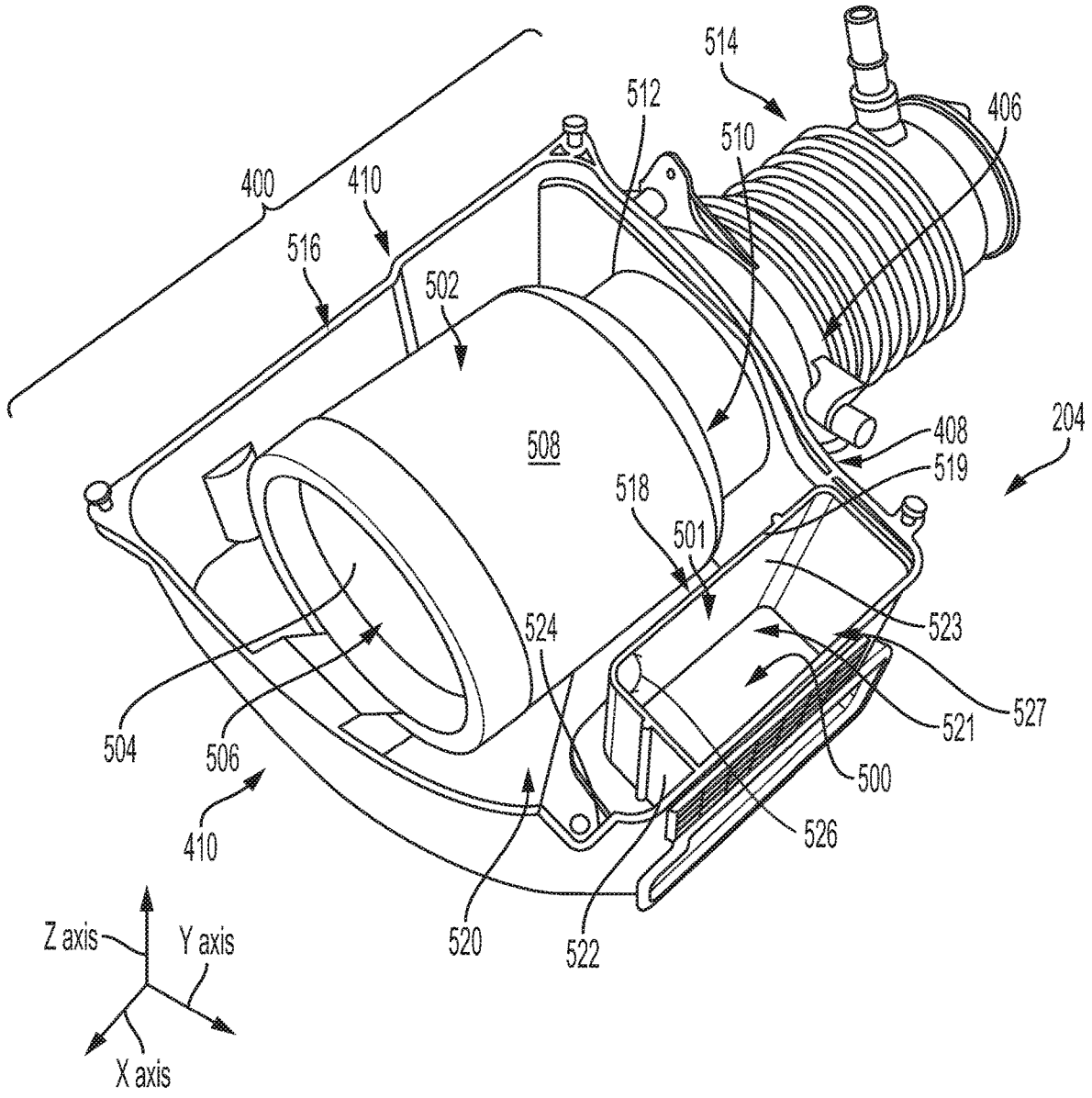
FIG. 5 shows a detailed view of a housing, filter enclosure, and filter element in the air filter device, illustrated in FIG. 4.
Figure 6:
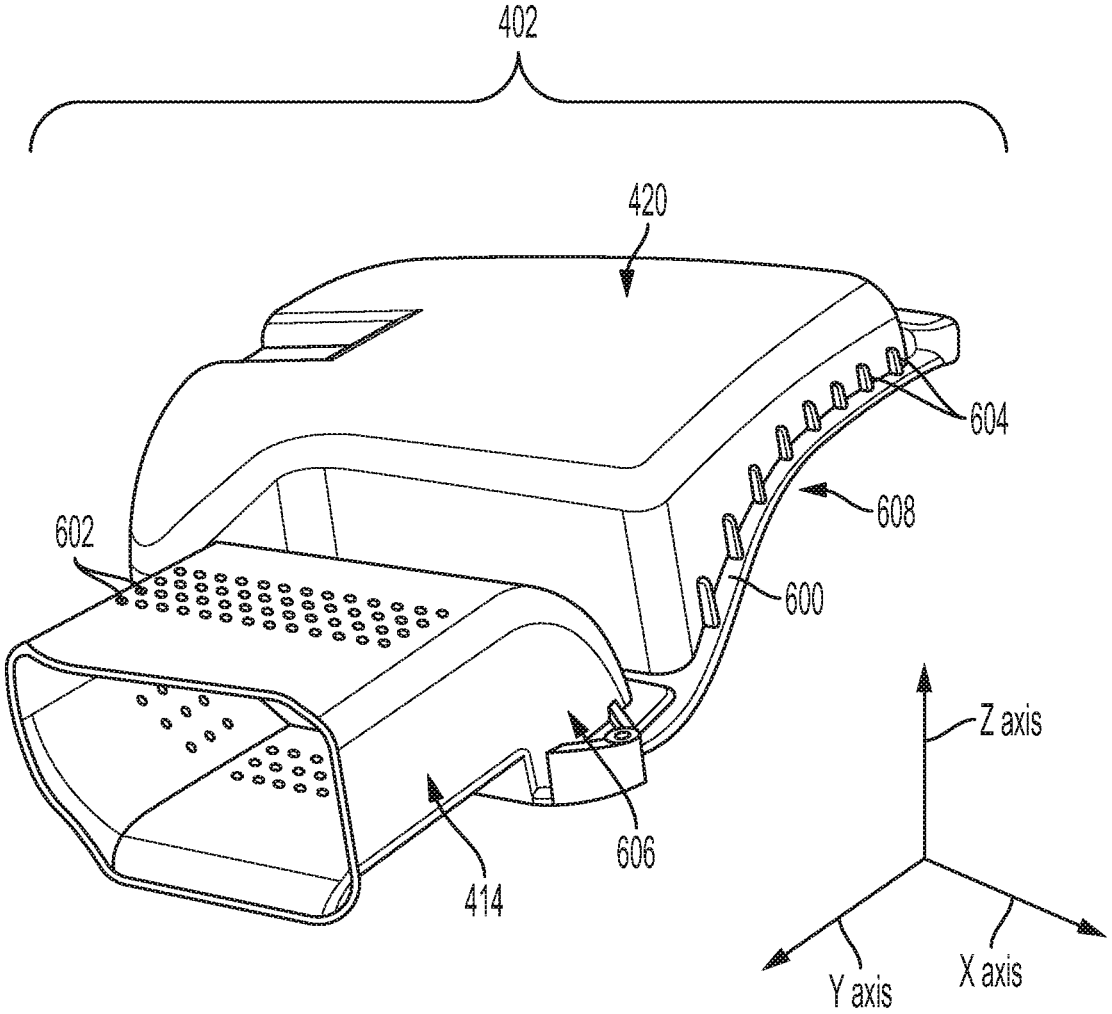
FIG. 6 shows a detailed view of a cover in the air filter device, illustrated in FIG. 4.
Figure 7:
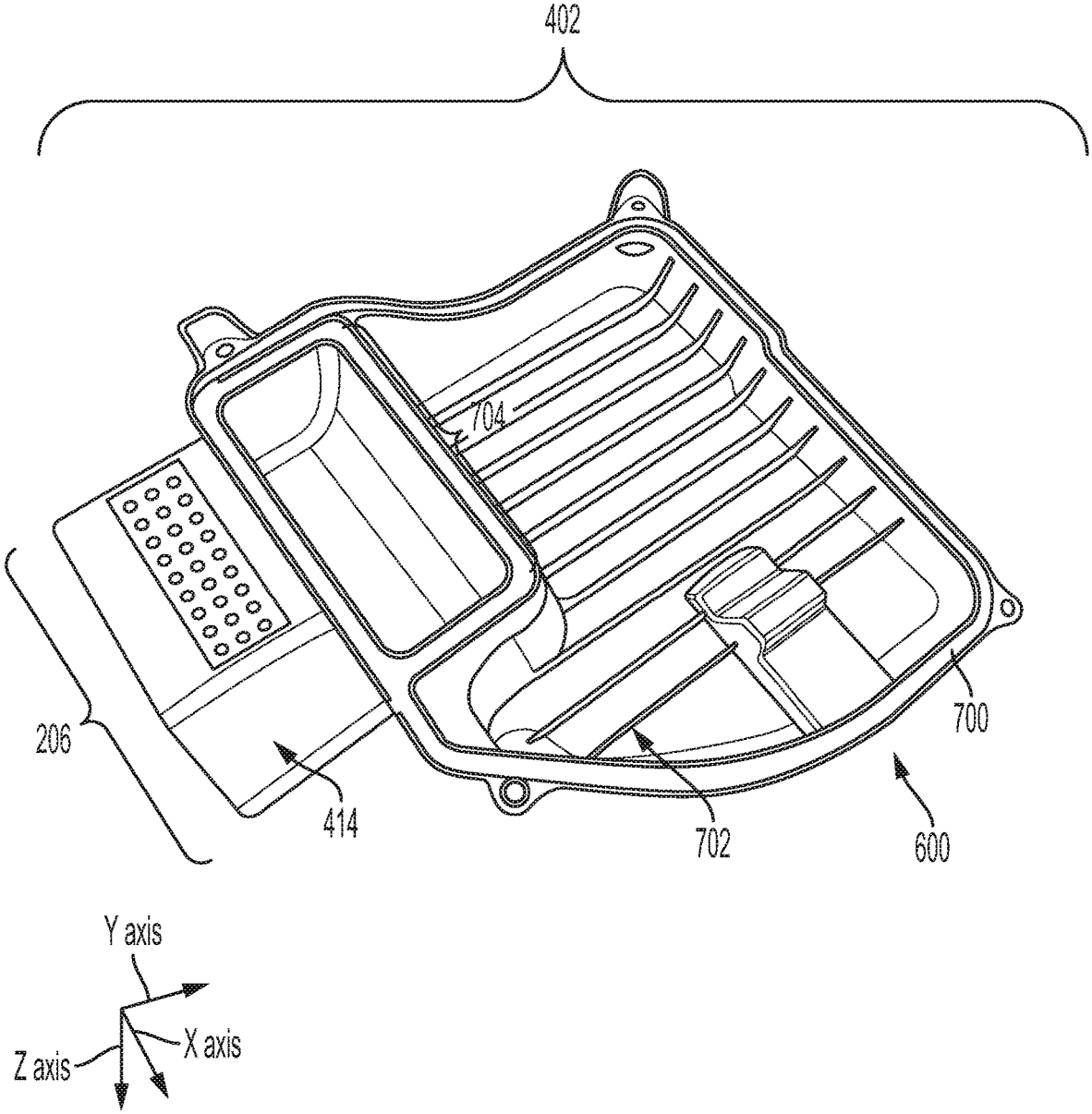
FIGS. 7-8 show different views of the cover, depicted in FIG. 6.
Figure 8:
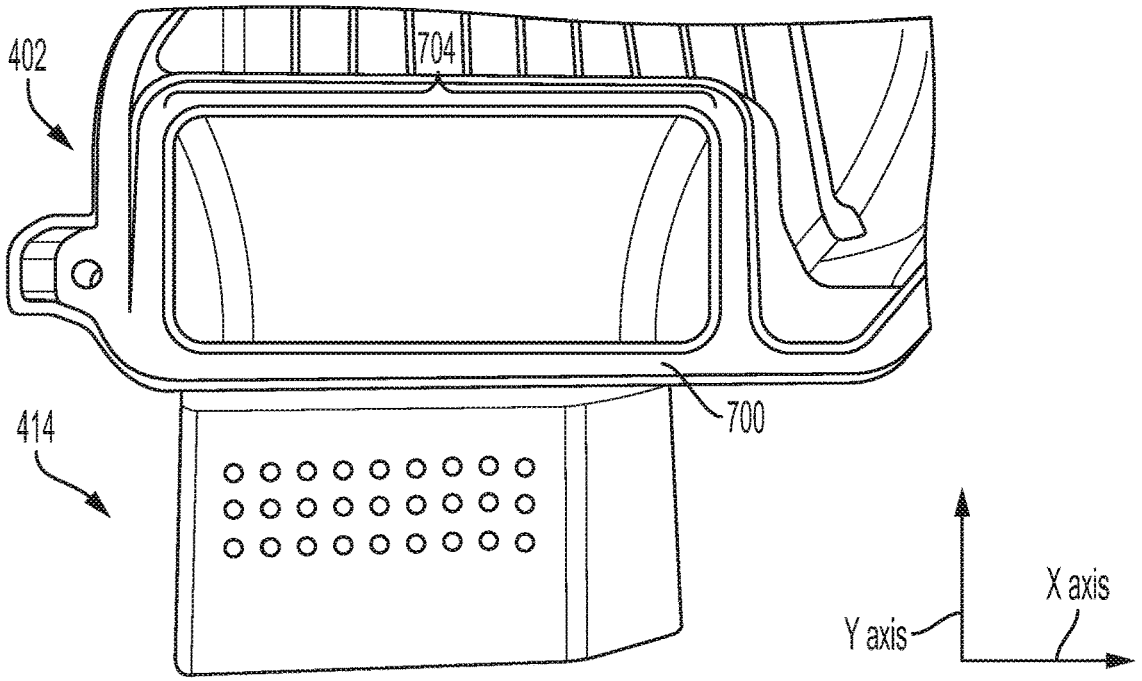
Figure 9:
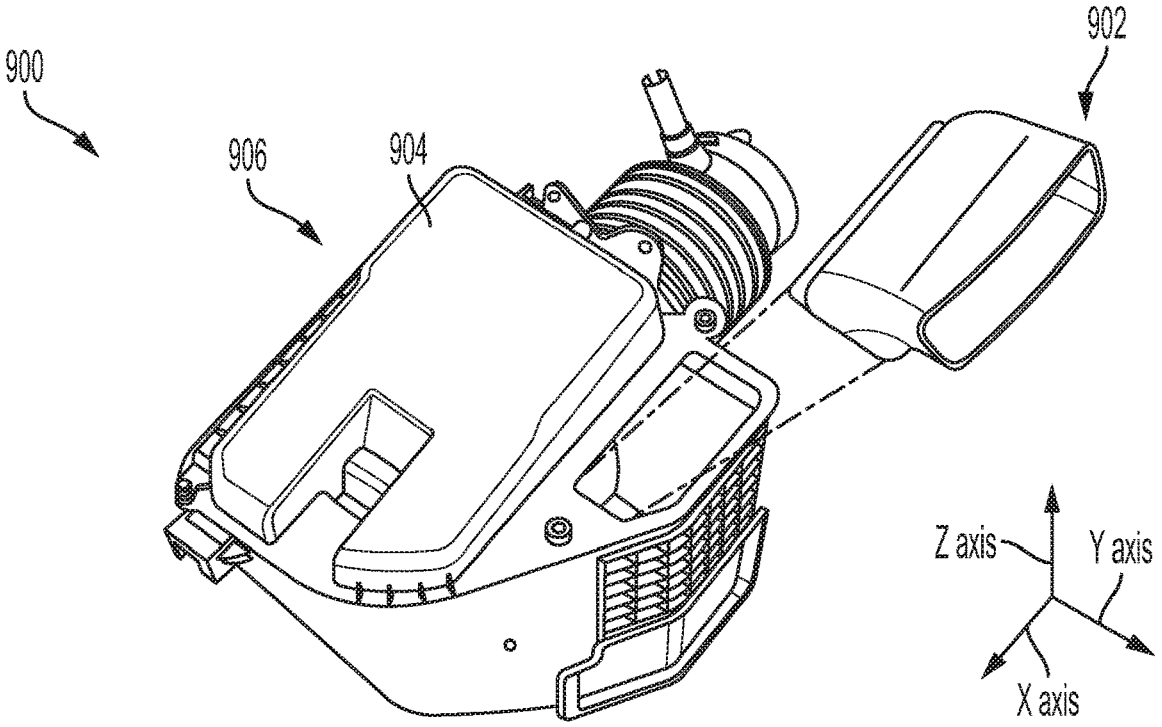
FIGS. 9-11 show different embodiments of air filter devices.
Figure 10:
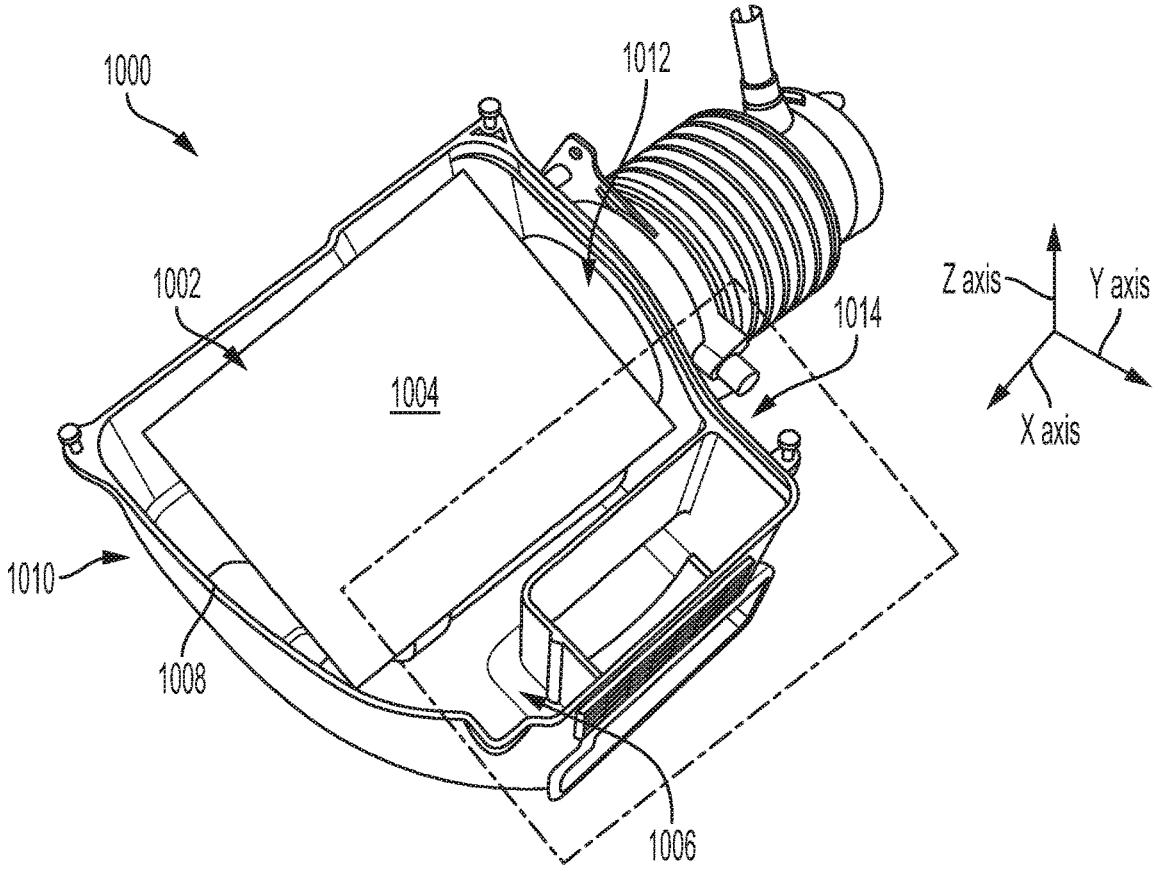
Figure 11:
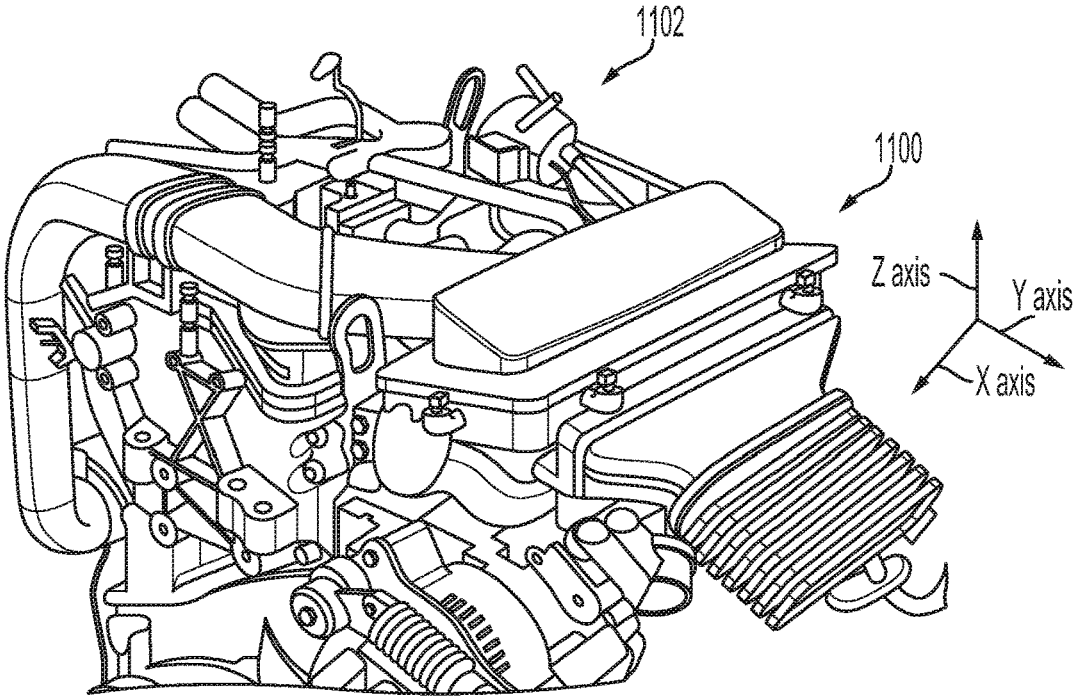
Figure 12:
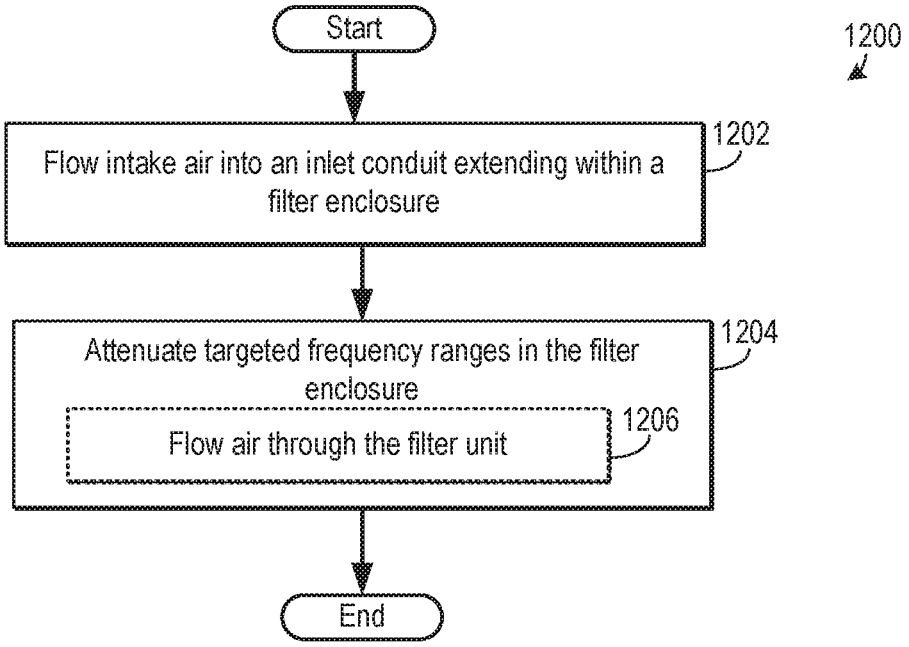
FIG. 12 shows a method for use of an air filter element.

FIG. 1 shows a schematic depiction of an engine employing an air intake system. FIG. 2 shows an example of a vehicle with an air intake system. FIG. 3 shows a front view of the vehicle and air intake system, shown in FIG. 2. FIG. 4 shows a detailed view of an air filter device, included in the air intake system, shown in FIG. 3. FIG. 5 shows a detailed view of a housing and filter enclosure used for resonance tuning in the air filter device, illustrated in FIG. 4. FIG. 6-8 depict different views of a cover of the air filter device, illustrated in FIG. 4. FIGS. 9-11 depict other embodiments of an air filter device. FIG. 12 shows a method for use of an air filter device.

Turning to FIG. 1, an engine 10 in a vehicle 12 with an air intake system 14 providing airflow to the engine 10 is schematically illustrated. Although, FIG. 1 provides a schematic depiction of various engine, vehicle, and air intake system components, it will be appreciated that at least some of the components may have a different spatial positions and greater structural complexity than the components shown in FIG. 1. The components' structural characteristics are discussed in detail herein, with regard to FIGS. 2-8.

The air intake system 14 specifically provides intake air to a cylinder 16. The cylinder 16 is formed by a cylinder block 18 coupled to a cylinder head 20. Although, FIG. 1 depicts the engine 10 with one cylinder, the engine 10 may have an alternate number of cylinders, in other examples. For instance, the engine 10 may include two cylinders, three cylinders, six cylinders, etc., in other examples.

The air intake system 14 includes a serviceable air filter device 26 (e.g., airbox) having a filter element 28 configured to remove particulates from air flowing there through. The air filter device 26 feeds intake air to an engine intake line 32 and receives unfiltered air from the surrounding environment. The air filter device is schematically depicted, but it will be understood that the air filter device 26 has additional structural complexity, components, functionality, etc., than is captured in FIG. 1. Detailed embodiments of the air filter device 26 are discussed in greater detail with regard to FIGS. 2-11.

The intake line 32, in turn, provides air to an intake valve 34 coupled to the cylinder 16. A throttle 36 may be positioned in an engine intake conduit 35 positioned downstream of the engine intake line 32. It will be appreciated that in other examples, such as in the case of a multi-cylinder engine, the engine intake conduit may be an intake manifold providing intake air to a plurality of cylinders.

The intake valve 34 may be actuated by an intake valve actuator 38. Likewise, an exhaust valve 40 may be actuated by an exhaust valve actuator 42. In one example, both the intake valve actuator 38 and the exhaust valve actuator 42 may employ cams coupled to intake and exhaust camshafts, respectively, to open/close the valves. Continuing with the cam driven valve actuator example, the intake and exhaust camshafts may be rotationally coupled to a crankshaft. Further, in such an example, the valve actuators may utilize one or more of cam profile switching (CPS), variable cam timing (VCT), variable valve timing (VVT), and/or variable valve lift (VVL) systems to vary valve operation. Thus, cam timing devices may be used to vary the valve timing, if desired. In another example, the intake and/or exhaust valve actuators, 38 and 42, may be controlled by electronic valve actuation. For example, the valve actuators, 38 and 42, may be electronic valve actuators controlled via electronic actuation. In yet another example, the cylinder 16 may alternatively include an exhaust valve controlled via electric valve actuation and an intake valve controlled via cam actuation including CPS and/or VCT systems. In other embodiments, the intake and exhaust valves may be controlled by a common valve actuator or actuation system.

An ignition system 44 may provide spark to the cylinder 16 via an ignition device 46 (e.g., spark plug) at desired time intervals. However, in compression ignition configurations the engine 10 may not include the ignition system 44. Additionally, a fuel delivery system 48 is also shown in FIG. 1. The fuel delivery system 48 provides pressurized fuel to the fuel injector 50 from a fuel tank 52 having a fuel pump 54. In the depicted example, the fuel injector 50 is a direct fuel injector. Additionally or alternatively, the fuel delivery system may be configured to deliver what is commonly referred to in the art as port fuel injection via a port fuel injector positioned upstream of the intake valve. The fuel delivery system 48 may include conventional components such as additional or alternative fuel pumps, check valves, return lines, etc., to enable fuel to be provided to the injectors at desired pressures. During engine operation, the cylinder 16 may undergo a four-stroke cycle including an intake stroke, compression stroke, expansion stroke, and exhaust stroke. Thus, the cylinder generates motive energy for the vehicle.

An exhaust system 56 configured to manage exhaust gas from the cylinder 16 is also included in the vehicle 12, depicted in FIG. 1. The exhaust system 56 includes the exhaust valve 40 coupled to the cylinder 16, and an exhaust conduit 58. The exhaust system 56 also includes an emission control device 60. The emission control device 60 may include filters, catalysts, absorbers, etc., for reducing tailpipe emissions.

FIG. 1 also shows a controller 100 in the vehicle 12. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 120, exhaust gas sensors 122, an intake airflow sensor 124, etc. Additionally, the controller 100 is also configured to receive a pedal position from a pedal position sensor 112 coupled to a pedal 114 actuated by an operator 116. The pedal adjustment may trigger corresponding adjustment to the position of the throttle 36.

The controller 100 may be configured to trigger one or more actuators and/or send commands to components. For instance, the controller 100 may trigger adjustment of the throttle 36, intake valve actuator 38, exhaust valve actuator 42, ignition system 44, and/or fuel delivery system 48. For example, the controller may send a command signal to the throttle to adjust an actuator therein causing movement (e.g., rotation) of a throttle plate. The other components receiving command signals from the controller may function in a similar manner. Therefore, the controller 100 receives signals from the various sensors and employs various actuators to adjust engine operation based on the received signals and instructions stored in memory of the controller.

Turning to FIG. 2, a perspective view of an example of a vehicle system 200 is provided. The vehicle system 200 is an embodiment of a system that may be included in the vehicle 12, shown in FIG. 1.

The vehicle system 200 includes an engine compartment 202 configured to at least partially enclose an engine (e.g., engine 10 shown FIG. 1) and an air filter device 204. The air filter device 204 includes an inlet port 206 providing unfiltered air to a filter element housed therein and an outlet port 208 in fluidic communication with a downstream intake line 210. In turn, the intake line 210 may provide air to downstream components such as an intake manifold, throttle, etc.

The vehicle system 200 further includes a frame rail 212 and a grill opening reinforcement structure 214 bounding portions of the engine compartment 202. A grill 216 is coupled to the grill reinforcement structure 214. The grill 216 may house a radiator, in one example. However, additional or alternative components may be attached to the grill, in other examples.

In FIGS. 2-11 coordinate axes (X, Y, and Z) are provided for reference. In one example, the Z axis may be parallel to a gravitational axis. Further, the X axis may be a lateral or horizontal axis and the Y axis may be a longitudinal axis. However, in other embodiments, the axes may have other orientations.

FIG. 3 shows a front view of the vehicle system 200. The air filter device 204, frame rail 212, grill reinforcement structure 214, and grill 216 are again shown. In one embodiment, an upper surface 300 of the air filter device 204 may or may not extend above an upper surface 302 of the grill reinforcement structure 214 depending on regional standards for vehicle zones (e.g., vehicle impact zone requirements), such as the zone demarcated via line 304. To elaborate, the air filter device 204 may be kept outside of a zone where the components may protrude from the vehicle when the frame and/or other front-end components are displaced via external forces. The line 304 provides an exemplary demarcation of the zone in FIG. 3. Exemplary, as described herein, does not convey any sort of preference of an aspect of the system but rather conveys the possibility of including the component, function, and the like into the system. Positioning the air filter device 204 with the vertical arrangement described above allows the vehicle system 200 to achieve a desired structural layout in the engine compartment, in certain embodiments. FIG. 4 shows a detailed view of the air filter device 204 and the air filter element 502 enclosed in a housing 400 of the device. The air filter element 502 is obstructed from view in FIG. 4. However, FIG. 5 illustrates an unobstructed view of the air filter element 502. Continuing with FIG. 4, the air filter device 204 also includes a cover 402 removably attached thereto. A seal 700, shown in FIG. 7, is provided in the interface between the housing and the cover to reduce the chance of unwanted air leaks from the device. Attachment devices 404 (e.g., bolts, clamps, clips, and the like) are used to attach the cover 402 to the housing 400.

The air filter device 204 includes a conduit 406 (e.g., cylindrical conduit) extending through a sidewall 408 of the housing 400 and includes the outlet port 208. Additional sidewalls 410 of the housing 400 along with a bottom wall 412, are also shown in FIG. 3. The sidewalls and bottom wall at least partially form a boundary of an interior filter enclosure.

The cover 402 includes the inlet port 206 and a neck section 414 with an airflow channel 415 therein. The neck extends laterally away from the housing 400. However, other neck contours have been envisioned. An upper surface 416 of the neck does not extend vertically above an upper surface 418 of a body 420 of the cover 402, in the illustrated embodiment. Arranging the neck and cover body in this manner increases device compactness. However, other contours of the cover where, for example, the neck extends above the cover body have been envisioned.

FIG. 4 shows the inlet port 206 and the outlet port 208 positioned on adjacent sides of the device which may allow for a compact airflow routing, in some situations. However, other port arrangement may be used in other embodiments, such as an arrangement of the inlet and outlet ports on opposing sides of the air filter device 204.

The cover 402, the housing 400, and/or conduit 406 may be constructed out of a suitable material such as a polymeric material, a composite material, a metallic material, combinations thereof, etc. Specifically, in one example the cover and the housing may be constructed out of a polymeric material such as polyethylene, polypropylene, Nylon, polybutylene terephthalate (PBT), polyoxymethylene (POM), etc.

FIG. 5 a view of the air filter device 204 with the cover 402, shown in FIG. 4, removed to reveal underlying components. Again, the housing 400 is illustrated. An inlet conduit 500 with an air passage 501 is also shown positioned in the housing and extending (e.g., vertically extending) there through. The inlet conduit 500 receives air from the neck 414 of the cover 402, shown in FIG. 4.

A filter-element 502 is also depicted in FIG. 5. In the illustrated embodiment, the filter element 502 has a cylindrical shape. However, other filter element profiles have been contemplated and are discussed in greater detail herein with regard to FIG. 10. The filter element 502 may be an enclosed resonator volume, in one example. The enclosed resonator volume may be designed to attenuate targeted frequency ranges. For instance, the length, cross-sectional area, material properties, etc., of the filter element 502 and corresponding housing may be adjusted to achieve desired noise attenuation properties.

The filter element 502 includes an end cap 504 extending across a first end 506 of the filter element to reduce the likelihood of unfiltered air leaking through the filter element. However, in other examples filter material may at least partially extend across the first end 506. A filter material 508 (e.g., foam, fiberglass, cotton, filament, fiber, combinations thereof, and the like) is shown circumferentially surrounding an interior cavity of the filter element. A second end 510 of the filter element 502 is coupled to the conduit 406 and flow air thereto. The conduit 406 is again shown extending through the sidewall 408. A sealing flange 512 is provided between the sidewall 408 and the conduit 406 to reduce, or eliminate in some cases, the chance of air leaks.

A flexible joint 514 is coupled to the conduit 406 and allows the air filter device 204 to be efficiently attached to downstream components. However, the conduit 406 may be attached to other suitable downstream components in other examples, such as a throttle body, more rigid conduit, and the like.

The housing 400 includes a peripheral lip 516 designed to seal with a flange 600 of the cover 402, shown in FIG. 6. Continuing with FIG. 5, the peripheral lip 516 extends around each of the sidewalls 408 and 410. The housing 400 also includes a wall 518 (e.g., partition) dividing the device's interior into a filter enclosure 520 and the inlet conduit 500. The wall 518 includes sections 522 and 523 arranged at an angle 526 (e.g., 90 degrees, 80 degrees, 60 degrees, etc.) with regard to one another. The sections 522 and 523 also extend inward from an interior surface 524 of the housing 400. However, in other examples, the wall may be curved in sections. The wall 518 also extends inward from the housing 400. It will be understood that the wall 518 and housing 400 form at least a partial boundary of the inlet conduit 500. The wall 518 includes a lip 519. The lip 519 of the wall 518 along with the peripheral lip 516 of the housing 400 interface with the seal 700 included in the cover 402, shown in FIG. 7 to seal the interior of the device. Consequently, the chance of air leaks in the device is reduced or eliminated, in some instances. It will be understood that the seal 700 may be an elastomeric seal, in one example. The elastomeric seal also allows the inlet conduit 500 to be fluidly separated from the filter enclosure 520 along a portion of its length. However, the inlet conduit 500 includes an outlet 521 providing fluidic communication between the filter enclosure 520 and the inlet conduit. The outlet 521 in the illustrated example, allows air to be expelled into the filter enclosure 520 below the filter element 502, allowing the enclosure to function as an acoustic attenuation chamber. However, other filter enclosure layouts may be used, in other examples.

The inlet conduit 500 extends vertically within the housing 400, in the depicted example. However, in other examples, at least a portion of the inlet conduit may extend laterally (e.g., inward) into the filter enclosure. The inlet conduit 500 includes an inlet opening 527 that may be in fluidic communication with the neck 414 of the cover 402, shown in FIG. 4.

FIG. 6 depicts a detailed view of the cover 402. The neck 414 along with the body 420 are again illustrated. In the depicted embodiment, the neck 414 includes perforations 602 allowing wakes in the air upstream of the neck to be reduced. However, the neck 414 may not include perforations, in other embodiments. The cover 402 also includes the sealing flange 600. Ribs 604 provide reinforcement for the flange. However, other cover contours may be used. The neck 414 is shown extending laterally outward and then curves vertically at section 606 of the neck near the flange 600. Furthermore, the neck 414 may be positioned vertically above the flange 600. As shown, the flange 600 includes an upwardly curved section 608 to accommodate for the height of the filter element 502, shown in FIG. 5. However, numerous flange contours have been envisioned.

FIG. 7 shows another a view of an underside 702 of the cover 402. A downstream outlet 704 of the neck 414 is shown. The downstream outlet 704 adjoins the inlet opening 527 of the inlet conduit 500, shown in FIG. 5. The inlet port 206 of the neck section 414 is also depicted in FIG. 7. FIG. 7 also shows the seal 700 in the cover 402. The seal 700 extends around the flange 600 allowing the filter enclosure 520 and the inlet conduit 500 to be substantially sealed. The seal 700 may be overmolded onto the flange. Overmolding, as defined herein, is a process where a substrate (e.g., the cover) is at least partially covered with an overmold material (e.g., the seal). For instance, the cover may be a polymeric material and a softer material (e.g., synthetic rubber, rubber, an elastomeric material, combinations thereof, etc.) may be injection molded onto the flange of the cover, in one example. However, other overmolding techniques have been envisioned. Alternately, the elastomeric seal may be separately formed and manually or automatically installed.

FIG. 8 shows a detailed view of the neck 414 and the seal 700 in the cover 402. As shown, a portion of the seal 700 extends around the downstream outlet 704 of the neck 414 to seal the neck from the filter enclosure 520, shown in FIG. 5.

FIG. 9 shows an embodiment of an air filter device 900 with a removable neck 902. To elaborate, the removable neck 902 is removably coupled to a body 904 of a cover 906 via attachment devices 908 (e.g., bolts, clips, hinges, welding, snap fittings, and the like). In this way, the modularity of the device is increased. It will be appreciated that the embodiment of the air filter device 900, shown in FIG. 9, as well as the other device embodiments described herein may include functional and/or structural features from the device embodiment shown in FIGS. 2-8 or vice versa, in some examples.

FIG. 10 shows another embodiment of an air filter device 1000. The air filter device 1000 includes a panel style filter element 1002. An upper surface 1004 of the panel 1002 is substantially planar, in the illustrated example. However, curved panel contours may be used, in other examples. The panel 1002 may extend across an enclosure 1006 and seal along a periphery 1008 of a housing 1010. In one example, the outlet conduit of the air filter device 1000 may be included in a cover (not shown). The panel 1002 may include a seal around its periphery, in one example. In such an example, a seal in the cover may be omitted. A cylindrical conduit 1012 may be positioned below the panel to allow for acoustic tuning in the device. The cylindrical conduit 1012 is also shown extending through wall 1014. In another example, the cover (not shown) of the air filter device 1000 may be designed to guide the filter element 1002 into a desired position. In this way, the likelihood of improper installation of the filter element is reduced.

FIG. 11 shows another embodiment of an air filter device 1100. The air filter device 1100 is attached to an engine 1102. The air filter device 1100 depicted in FIG. 11 may include a cylindrical filter have resonance tuning characteristics similar to the air filter device 204, shown in FIGS. 2-8. As such, redundant description is omitted for brevity.

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Elements circumferentially surrounding another element may be referred to as such, in one example.

FIG. 12 shows a method 1200 for use of an air filter device in an air intake system. Method 1200 may be implemented via the air intake systems and air filter devices described above with regard to FIGS. 1-11. However, in other embodiments the method 1200 may be implemented via other suitable air intake systems and air filter devices. The method 1200 may be stored in non-transitory memory of a controller. Furthermore, the method 1200 may include instructions within a controller as well actions taken by the controller. It will also be understood that the method 1200 may include at least some steps that are at least partially passively implemented. For instance, step of flowing intake air through a component may be a passive action initiated via the generation of a vacuum in the intake manifold caused by cyclical combustion operation in the engine.

At 1202, the method includes, in an air filter device, flowing intake air into an inlet conduit extending within a filter enclosure, where the inlet conduit opens into a filter enclosure vertically below a filter element. Next at 1204, the method may further includes attenuating targeted frequency ranges (e.g., frequencies between 70 Hertz (Hz) and 350 Hz) in the filter enclosure. For instance, the interaction between the filter element (e.g., cylindrical filter element) and the inlet conduit may cause desired noise attenuation in the enclosure. Thus, the attenuation step may include at 1206, flowing air through the cylindrical filter element. Method 1200 allows airflow patterns in the device to achieve desired acoustic and specifically sound attenuation properties. Consequently, NVH in the air intake system can be reduced, if wanted.

The technical effect of providing an air filter device with a cover that fluidly separates an inlet conduit from a filter enclosure in a housing of the device is to increase the compactness of the device as well as provide resonance tuning in the device to reduce NVH.

The invention will further be described in the following paragraphs. In one aspect, an air filter device is provided that comprises a housing enclosing a filter element positioned in a filter enclosure, the filter element including an outlet in fluidic communication with a downstream intake line; an inlet conduit extending within the housing and delivering air to the filter enclosure, the inlet conduit including a wall dividing the filter enclosure from the inlet conduit; and a cover sealingly attached to the wall and a peripheral lip of the housing.

In another aspect, a method is provided that comprises, in an air filter device, flowing intake air into an inlet conduit extending within a filter enclosure, where the inlet conduit opens into the filter enclosure vertically below a filter element; attenuating a targeted frequency range in the filter enclosure; where the air filter device includes: a housing enclosing the filter element positioned in the filter enclosure, where the filter element includes an outlet in fluidic communication with a downstream intake line; the inlet conduit extending within the housing and delivering air to the filter enclosure, where the inlet conduit includes a wall dividing the filter enclosure from an airflow passage of the inlet conduit; and a cover including a seal interfacing with a lip of the wall and a peripheral lip of the housing. In one example, the method may further comprise flowing air through the cylindrical filter element.

In another aspect, an air filter device is provided that comprises a housing enclosing a filter element positioned in a filter enclosure, where the filter element includes an outlet in fluidic communication with a downstream intake line; an inlet conduit extending within the housing and delivering air to the filter enclosure, where the inlet conduit includes a wall dividing the filter enclosure from an airflow passage of the inlet conduit; and a cover including a seal interfacing with a lip of the wall and a peripheral lip of the housing; where the inlet conduit vertically extends through the filter enclosure, where an outlet of the inlet conduit is positioned below the filter element, and where the wall extends inward from the housing. In any of the aspects herein or combinations of the aspects, the filter element may be cylindrical and fixedly attached to a cylindrical conduit extending through a wall of the housing.

In any of the aspects herein or combinations of the aspects, the filter element may be in the form of a panel having a substantially planar upper surface.

In any of the aspects herein or combinations of the aspects, the air filter device may further comprise a cylindrical resonator positioned below the panel.

In any of the aspects herein or combinations of the aspects, an upper surface of the cover may be positioned vertically below an upper surface of a grill opening reinforcement structure.

In any of the aspects herein or combinations of the aspects, the inlet conduit may vertically extend through the filter enclosure.

In any of the aspects herein or combinations of the aspects, an outlet of the inlet conduit may be positioned below the filter element.

In any of the aspects herein or combinations of the aspects, the cover may include an overmolded seal interfacing with a lip of the wall and the peripheral lip of the housing.

In any of the aspects herein or combinations of the aspects, the cover may include a removable neck in fluidic communication with the inlet conduit.

In any of the aspects herein or combinations of the aspects, the filter element may be cylindrical and fixedly attached to a cylindrical conduit extending through a wall of the housing.

In any of the aspects herein or combinations of the aspects, the filter element may be in the form of a panel having a substantially planar upper surface.

In any of the aspects herein or combinations of the aspects, the air filter element may further comprise a cylindrical resonator positioned below the panel.

In any of the aspects herein or combinations of the aspects, the inlet conduit may vertically extend through the filter enclosure and an outlet of the inlet conduit may be positioned below the filter element.

In any of the aspects herein or combinations of the aspects, the cover may include an inlet neck in fluidic communication with the inlet conduit.

In any of the aspects herein or combinations of the aspects, the filter element may be cylindrical and fixedly attached to a cylindrical conduit extending through a wall of the housing.

In any of the aspects herein or combinations of the aspects, the filter element may be in the form of a panel having a substantially planar upper surface.

In any of the aspects herein or combinations of the aspects, the air filter device may further comprise a cylindrical resonator positioned below the panel.

In any of the aspects herein or combinations of the aspects, an upper surface of the cover may be positioned vertically below an upper surface of a grill opening reinforcement structure.

In any of the aspects or combinations of the aspects, the inlet conduit may vertically extend through the filter enclosure, an outlet of the inlet conduit may be positioned below the filter element, and the wall may extend inward from the housing.

In any of the aspects or combinations of the aspects, the air filter device may include an enclosure comprising a tuned resonator volume positioned below the panel.

In any of the aspects or combinations of the aspects, the air filter device may further comprise an enclosed resonator volume positioned below the panel.

In any of the aspects or combinations of the aspects, the inlet conduit may vertically extend through the filter enclosure, an outlet of the inlet conduit may be positioned below the filter element, and the partition may extend inward from the housing.

In another representation, an airbox is provided with a removable cover having a neck configured to draw in surrounding air and a housing including a filter enclosure with an intake conduit and a cylindrical filter positioned therein, where the cylindrical filter is coupled to a cylindrical conduit extending through a wall of the housing, where the intake conduit is in fluidic communication with the neck, and where a seal in the removable cover allows for fluidic division of the filter chamber from the intake conduit.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the terms "approximately" and "substantially" are construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An air filter device, comprising:

a housing enclosing a filter element positioned in a filter enclosure, the filter element including an outlet in fluidic communication with a downstream intake line;

an inlet conduit extending within the housing and delivering air to the filter enclosure, the inlet conduit including a single, continuous wall dividing the filter enclosure from the inlet conduit; and a cover sealingly attached to the wall and a peripheral lip of the housing.

2. The air filter device of claim 1, where the filter element is cylindrical and fixedly attached to a cylindrical conduit extending through a wall of the housing.

3. The air filter device of claim 1, where the filter element is in the form of a panel having a substantially planar upper surface.

4. The air filter device of claim 3, further comprising a cylindrical resonator positioned below the panel.

5. The air filter device of claim 1, where an upper surface of the cover is positioned vertically below an upper surface of a grill opening reinforcement structure.

6. The air filter device of claim 1, where the inlet conduit vertically extends through the filter enclosure.

7. The air filter device of claim 6, where an outlet of the inlet conduit is positioned below the filter element.

8. The air filter device of claim 1, where the cover includes an overmolded seal interfacing with a lip of the wall and the peripheral lip of the housing.

9. The air filter device of claim 1, where the cover includes a removable neck in fluidic communication with the inlet conduit.

10. A method, comprising:

in an air filter device, flowing intake air into an inlet conduit extending within a filter enclosure, where the inlet conduit opens into a filter enclosure vertically below a filter element; and attenuating targeted frequency ranges in the filter enclosure;

where the air filter device includes:

a housing enclosing the filter element positioned in the filter enclosure, where the filter element includes an outlet in fluidic communication with a downstream intake line;

the inlet conduit extending within the housing and delivering air to the filter enclosure, where the inlet conduit includes a single, continuous partition dividing the filter enclosure from an airflow passage of the inlet conduit; and a cover including a seal interfacing with a lip of the partition and a peripheral lip of the housing.

11. The method of claim 10, where the filter element is cylindrical and fixedly attached to a cylindrical conduit extending through a wall of the housing and where the method further comprises flowing air through the cylindrical filter element.

12. The method of claim 10, where the filter element is in the form of a panel having a substantially planar upper surface.

13. The method of claim 12, where the air filter device includes an enclosure comprising a tuned resonator volume positioned below the panel.

14. The method of claim 10, where the inlet conduit vertically extends through the filter enclosure, where an outlet of the inlet conduit is positioned below the filter element, and where the partition extends inward from the housing.

15. The method of claim 9, where the cover includes an inlet neck in fluidic communication with the inlet conduit.

16. An air filter device, comprising:

a housing enclosing a filter element positioned in a filter enclosure, where the filter element includes an outlet in fluidic communication with a downstream intake line;

an inlet conduit extending within the housing and delivering air to the filter enclosure, where the inlet conduit includes a single, continuous wall dividing the filter enclosure from an airflow passage of the inlet conduit; and a cover including a seal interfacing with a lip of the wall and a peripheral lip of the housing;

where the inlet conduit vertically extends through the filter enclosure and where an outlet of the inlet conduit is positioned below the filter element; and where the inlet conduit vertically extends through the filter enclosure, where an outlet of the inlet conduit is positioned below the filter element, and where the wall extends inward from the housing.

17. The air filter device of claim 16, where the filter element is cylindrical and fixedly attached to a cylindrical conduit extending through a wall of the housing.

18. The air filter device of claim 16, where the filter element is in the form of a panel having a substantially planar upper surface.

19. The air filter device of claim 18, further comprising an enclosed resonator volume positioned below the panel.

20. The air filter device of claim 16, where an upper surface of the cover is positioned vertically below an upper surface of a grill opening reinforcement structure.

* * * * *